US005393263A

United States Patent [19]

McCabe

[11] Patent Number: 5,393,263

[45] Date of Patent: Feb. 28, 1995

[54] ACCESS DOOR ELIMINATOR FOR CURTAIN FIRE DAMPERS

[76] Inventor: Francis J. McCabe, #6 Bunker Hill Rd., Ottsville, Pa. 18962

[21] Appl. No.: 206,503

[22] Filed: Mar. 4, 1994

[51] Int. Cl.[6] ..... E05F 15/20

[52] U.S. Cl. ..... 454/257; 16/48.5; 160/1; 454/369

[58] Field of Search ..... 16/48.5; 160/1, 6, 9; 454/257, 258, 357, 369

[56] References Cited

U.S. PATENT DOCUMENTS 3,796,248 3/1974 McCabe ..... 160/1
3,796,249 3/1974 McCabe ..... 160/1
4,195,384 4/1980 McCabe ..... 160/9 X
4,287,638 9/1981 McCabe ..... 16/48.5
4,648,310 3/1987 Wescoat et al. ..... 454/369
5,261,186 11/1993 Saino ..... 160/1 X

*Primary Examiner*—Harold Joyce
*Attorney, Agent, or Firm*—Frank J. Benasutti

[57] ABSTRACT

A mechanism is provided to engage a resettable link in a curtain-type fire damper and release and reset that link so that the blades of the damper can unfold. The mechanism is actuated remotely and mechanically without the need for an access door.

4 Claims, 6 Drawing Sheets

ACCESS DOOR ELIMINATOR FOR CURTAIN FIRE DAMPERS

TECHNICAL FIELD

This invention relates to fire damper control devices and, in particular, to devices for remotely setting and resetting fire dampers used in air ducts.

BACKGROUND ART

In the prior art numerous devices have been proposed and used for setting and resetting fire dampers of the type known as "curtain" dampers. These dampers are mounted in frames which fit into air ducts so as to close like a curtain; dropping when a heat actuated link disengages the retaining wire holding the folded curtain in a folded condition at the top of a frame. In order to test the device periodically, it is desirable to release and reset it. In order to accomplish this, it is necessary to have an access door to give access to the duct work containing the damper, and thus provide access to the damper control mechanism.

DISCLOSURE OF INVENTION

It is desirable to eliminate that access door, yet have complete control of the reset mechanism so that it can be set and reset from a remote location. I have provided such a mechanism, which broadly comprises three interacting mechanisms for controlling the position of the curtain in a curtain-type fire damper. The damper is normally retained by a flexible cable connected to a resettable link. I have been patented such links, which comprise a serpentine folded bi-metal device, which includes a pin which fits through a hole to lock the device in its closed position. If the serpentine, or fan-folded, link is heated, the bi-metal causes the pin to retract from the hole and release the heavy metal curtain, so that it drops and closes off the ducts through which air and smoke are flowing.

In the present invention, I have provided a pivoted bracket, which is engaged by a stop means crimped to a flexible cable as the cable is drawn from the frame of the damper in order to raise the damper blades into a folded condition. This engagement takes place just before the damper is fully raised, so that as it is fully raised to its final open position, the stop means pivots the bracket and causes a portion of the bracket to engage the pin and be locked with it (just as the pin locks the release mechanism in the closed position; as has been known in the prior).

When it is desirable to release the mechanism, a tab which extends from the housing of the fire damper is toggled to push the portion of the heat actuateable link which has the pin extending from it, from a position engaging the bracket to a position where it releases the bracket and thereby releases the cable. It will be noted that in the fully opened position the cable is retained by the stop means engaging a portion of the bracket, so that the cable stays in that position and retains the curtain fire damper in its fully-folded, open position. Upon pivoting of the bracket, the stop means slips out of an engagement with the portion of the bracket which is retaining it and allows for the closing of the damper by gravity.

To actuate the lever or tab which pushes the releasable, heat-actuated link out of engagement, I have provided a second cable which is fastened to the tab and which passes through the environmental structure in which the damper is mounted, to a remote location.

Accordingly, an object of this invention is to provide a means for setting and resetting a heat-actuateable damper from a remote location without the need of an access door to gain access to the environment in which the damper is mounted.

This and other objects of the invention will become apparent from the following description with reference to the accompanying drawings.

MODES FOR CARRYING OUT THE INVENTION

Figure 1:
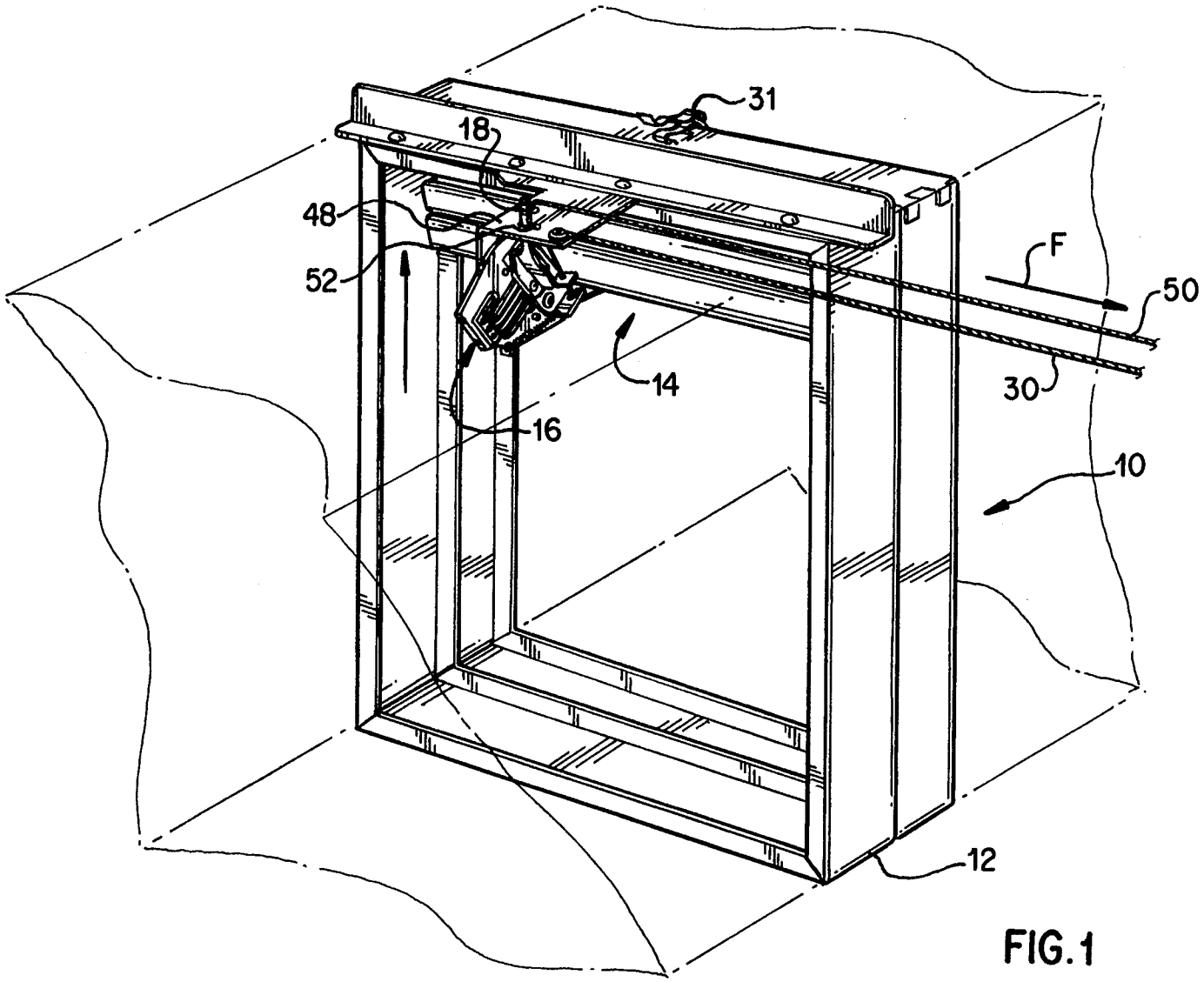
FIG. 1 is a perspective view of a curtain-type fire damper shown in the open position, wherein the curtain portion is fully raised vertically to the top of the fire damper; shown mounted in an environment (shown in phantom lines) representing an air duct.
Figure 2:
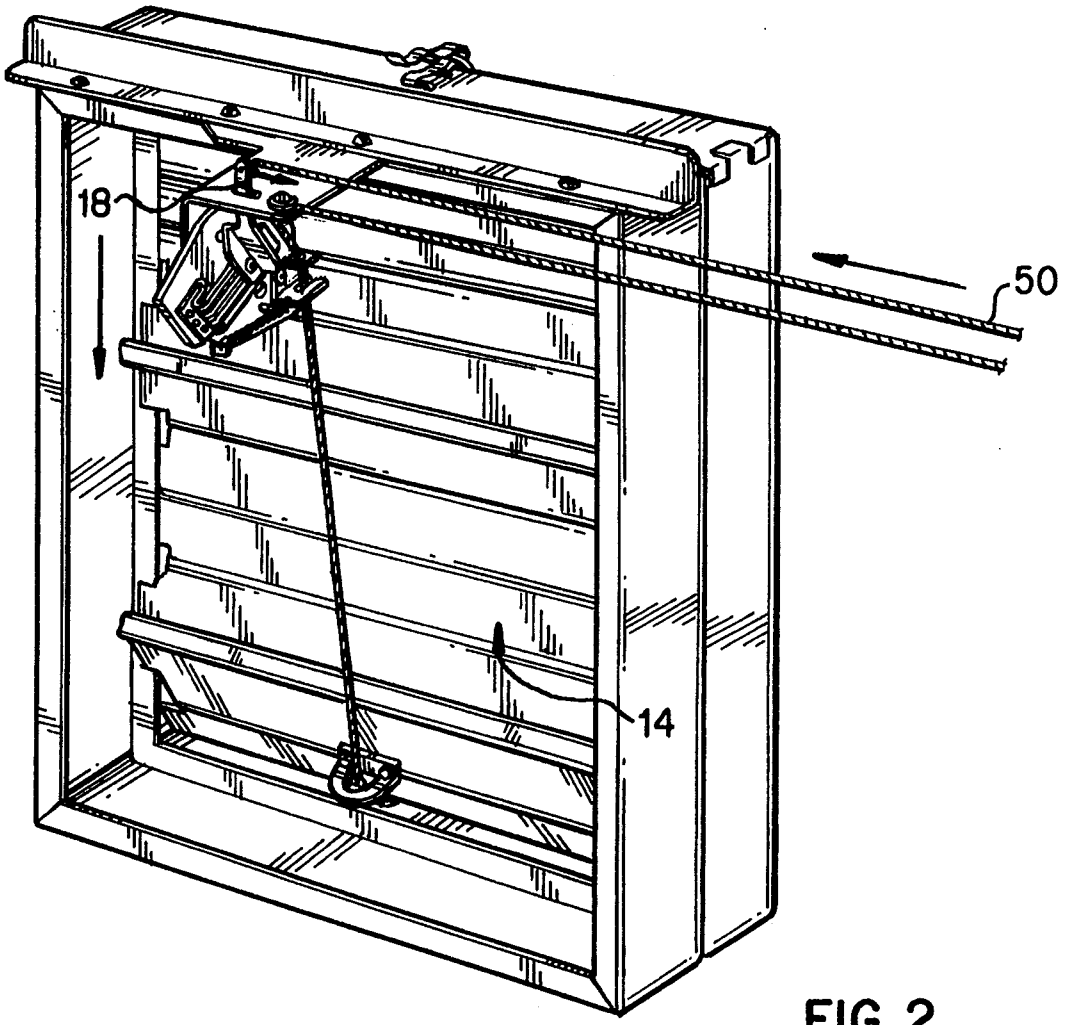
FIG. 2 is a perspective view of the device shown in FIG. 1 with the curtain damper shown in its closed position.

Referring to the drawings, FIG. 1 shows a curtain-type fire damper designated generally 10 mounted in its normal environment within a air duct shown in phantom lines. The curtain-type fire damper comprises a frame 12 and plurality of blades designated generally 14 which are retained (as shown in FIG. 1) in a fan-folded condition so as to maintain the damper in an open condition to allow the passage of air. The damper is designed to close if the air temperature rises such as is the case when there is a fire in the building. It closes automatically because a heat-actuateable link either melts or, as in the case in the present invention, moves to a position where it releases the means which is maintaining the blades in the fan-folded condition and allows those blades to move from the position shown in FIG. 1 to the position shown in FIG. 2. The blades move by gravity and close off the air duct by forming a curtain, as shown in FIG. 2.

The bi-metal link device is designated generally 16 and comprises a serpentine mechanism known in the art and disclosed in my prior art U.S. Pat. Nos. 3,725,972; 3,796,248; 3,796,249; 3,866,656; 3,889,314; 3,977,456; 4,040,304; 4,041,570; 4,074,388; 4,099,292; 4,195,384; 4,200,954; 4,213,227; 4,287,638; 4,301,569; 4,372,485; 4,555,981; AND 4,905, 344; some of which also disclose re-set means. In operation, the link which normally retains the mechanism in the fan-folded position by means of a pin passing through a hole moves under the operation of heat to retract the pin from the hole and release the mechanism, thereby letting the damper close. That portion of the link which has the pin attached to it can be manually or mechanically removed by means other than heat.

In such a device I have provided in accordance with my invention, a release/reset means which is remotely actuateable. In the device depicted in the figures of this application, the link release means for manually moving the bi-metal link comprises a lever 18 which is fixedly attached to the free end of the bi-metal portion 20 of the link 16; as by means of riveting at the point 22. Pulling on the lever 18 in the direction of the arrow A, FIG. 6, will move the free end 20 of the bi-metal link and withdraw the pin 24 from engagement with the pivotable bracket 26. The pin, as will be noted from FIG. 6, engages the bracket 26 by passing through a hole, designated generally 28, in the bracket 26.

Figure 3:
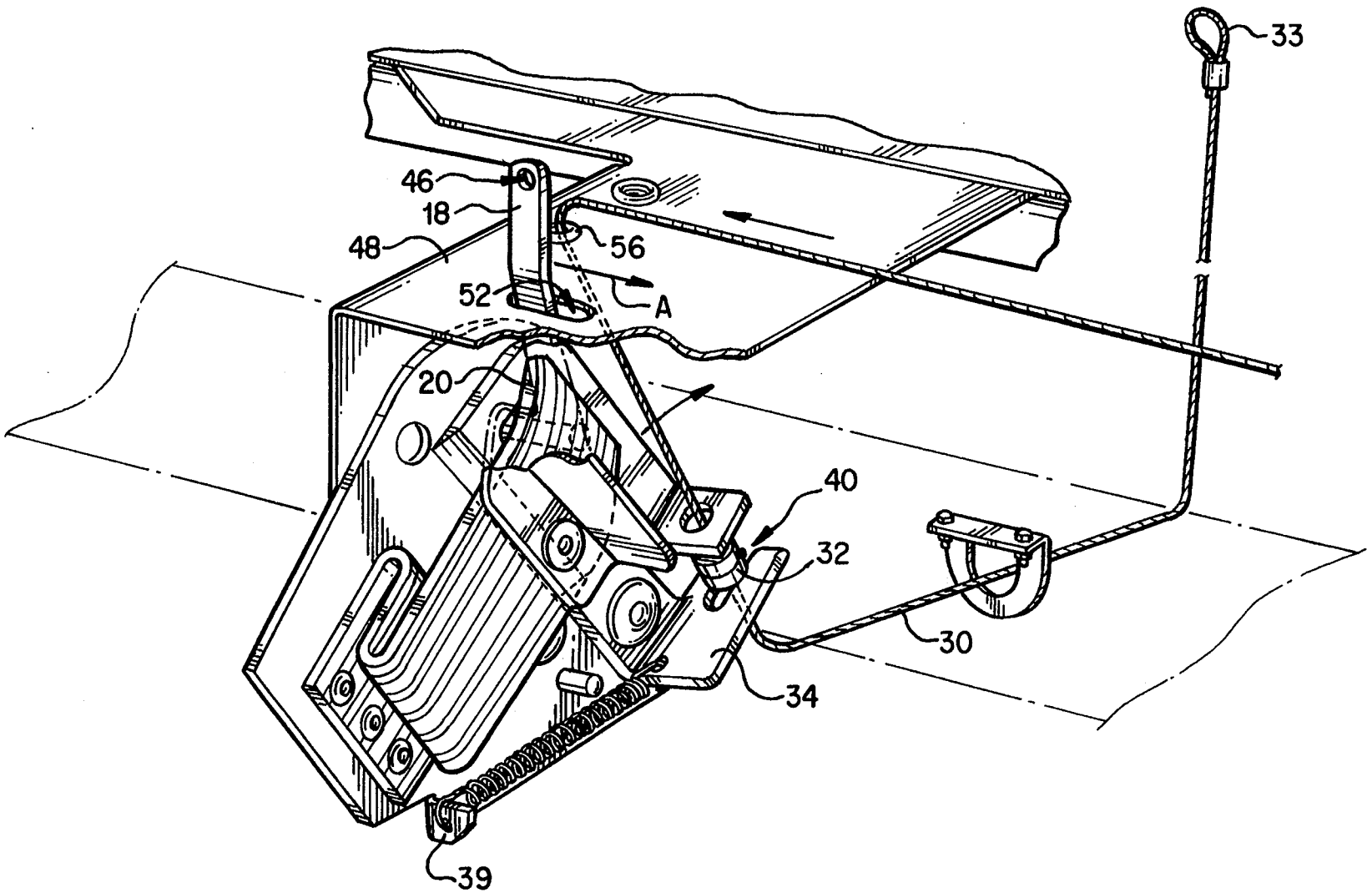
FIG. 3 is an enlarged perspective view of a portion of the apparatus shown in FIG. 2.
Figure 4:
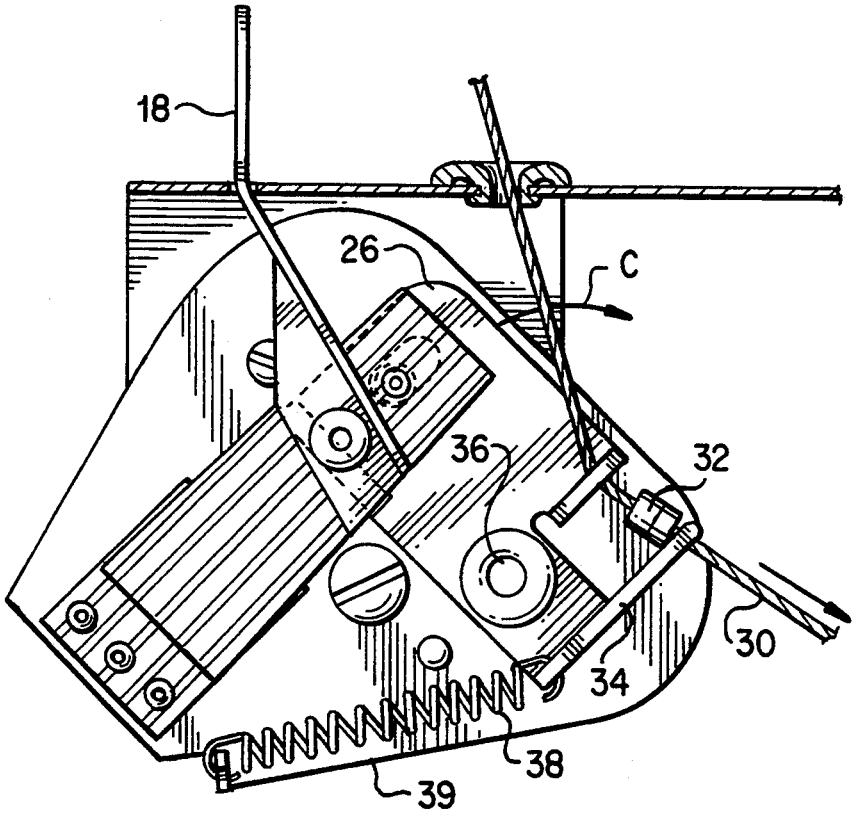
FIG. 4 is an elevation taken from the right side of the device shown in FIG. 3.

In the condition shown in FIGS. 1, 2, 3, 4 and 6, the flexible cable 30, which is attached at one end to a clip 31 by the loop 33 FIG. 3 (not shown in detail, but known per se) to the frame 12, has been withdrawn from the frame and environment of damper to the extent that it has raised the curtain and retained the blades 14 in their fan-folded condition. The cable 30 is retained by means of a stop means 32, which is most preferably a copper jacket crimped to the cable 30 and which rests against the flange 34 of the bracket 26. In those figures the pivotal bracket 26 is retained from moving about its pivot point by the pin 24 as aforesaid. It would tend to move about that pivot 36 under the force of the extended spring 38, were it not so retained. As shown in FIG. 4, one end of the spring is connected to the mounting plate 39 which is fixedly mounted to the frame of the damper, and the other end of the spring is mounted through a hole in the flange 34. The spring is in tension, as depicted in FIG. 4.

Figure 6:
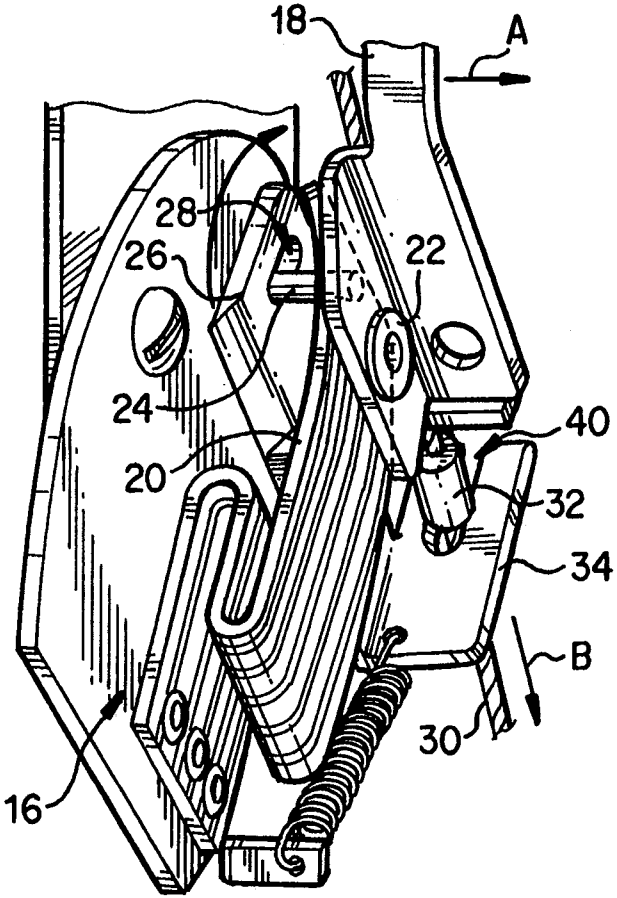
FIG. 6 is a perspective view of a portion of the parts shown in FIG. 3 taken from another angle.

The end of the flange 34 which retains the stop means 32 is bifurcated so that it forms a slot designated generally 40 as shown in FIG. 6. Since the stop means 32 cannot pass through the slot 40 in the position shown and since it is crimped to the cable 30, the cable cannot move in the direction of the arrow B in FIG. 6.

Figure 5:
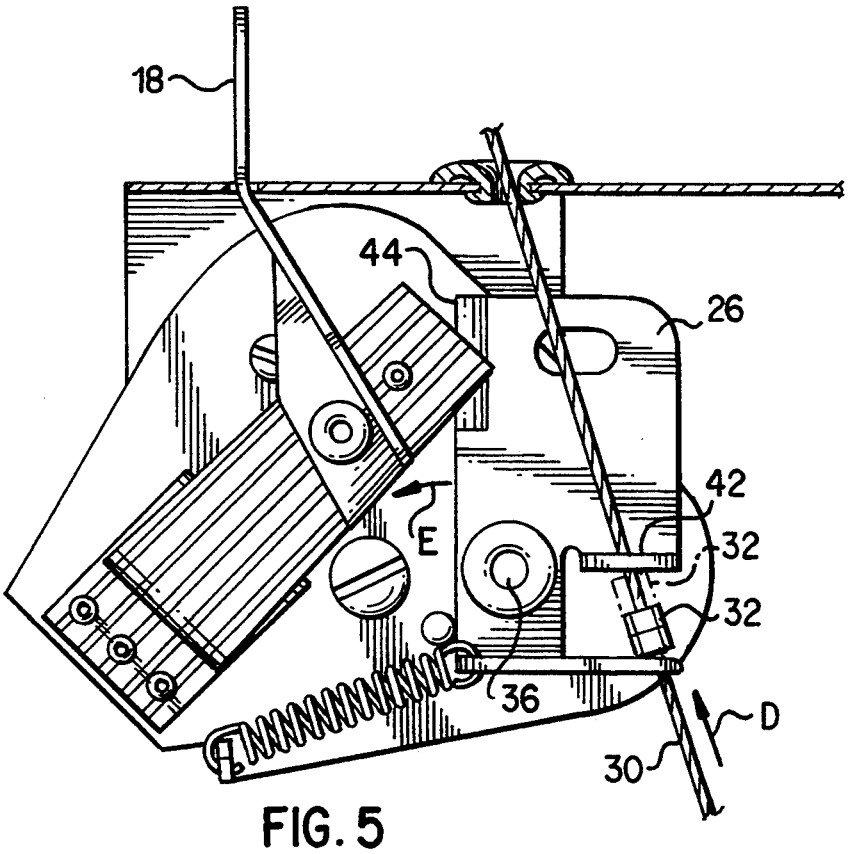
FIG. 5 is a view similar to FIG. 4 with the parts shown in an alternate position.
Figure 7:
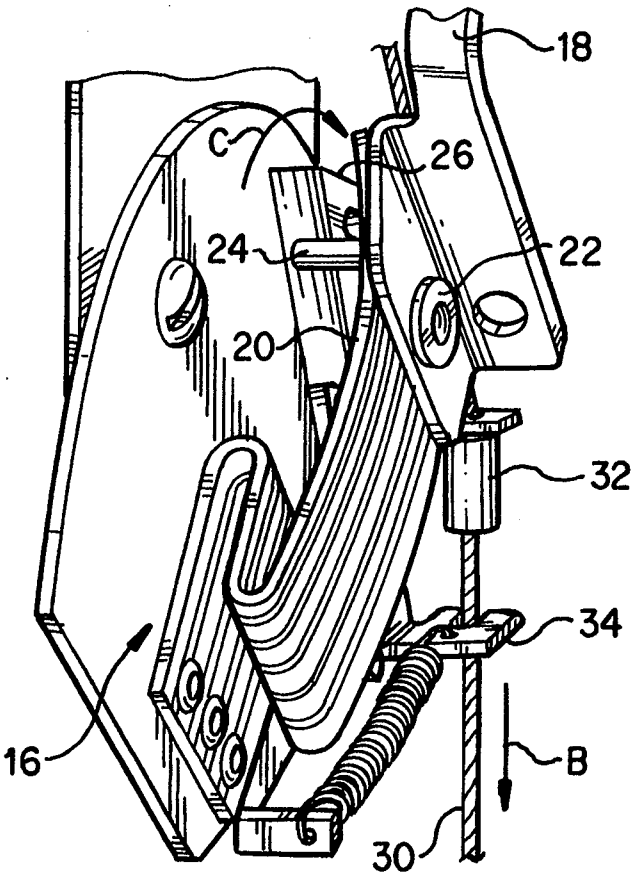
FIG. 7 is a perspective of a portion of the parts shown in FIG. 5.

When the lever 18 is moved from a position shown in FIGS. 3 and 6 to the position shown in FIG. 7, it causes the pin 24 to release the bracket 26 and allow the spring 38 to pull the bracket around its pivot point 36 in a clockwise direction as shown by the arrow C in FIG. 4 and move the bracket 26 to the position shown in FIGS. 5 and 7.

This allows the stop means 32 to slide out of engagement with the flange 34 and thereby release the cable 30 to move in the direction of arrow B, FIG. 6 and 7, allowing the curtain damper to close off the damper opening under the force of gravity.

Figure 8:
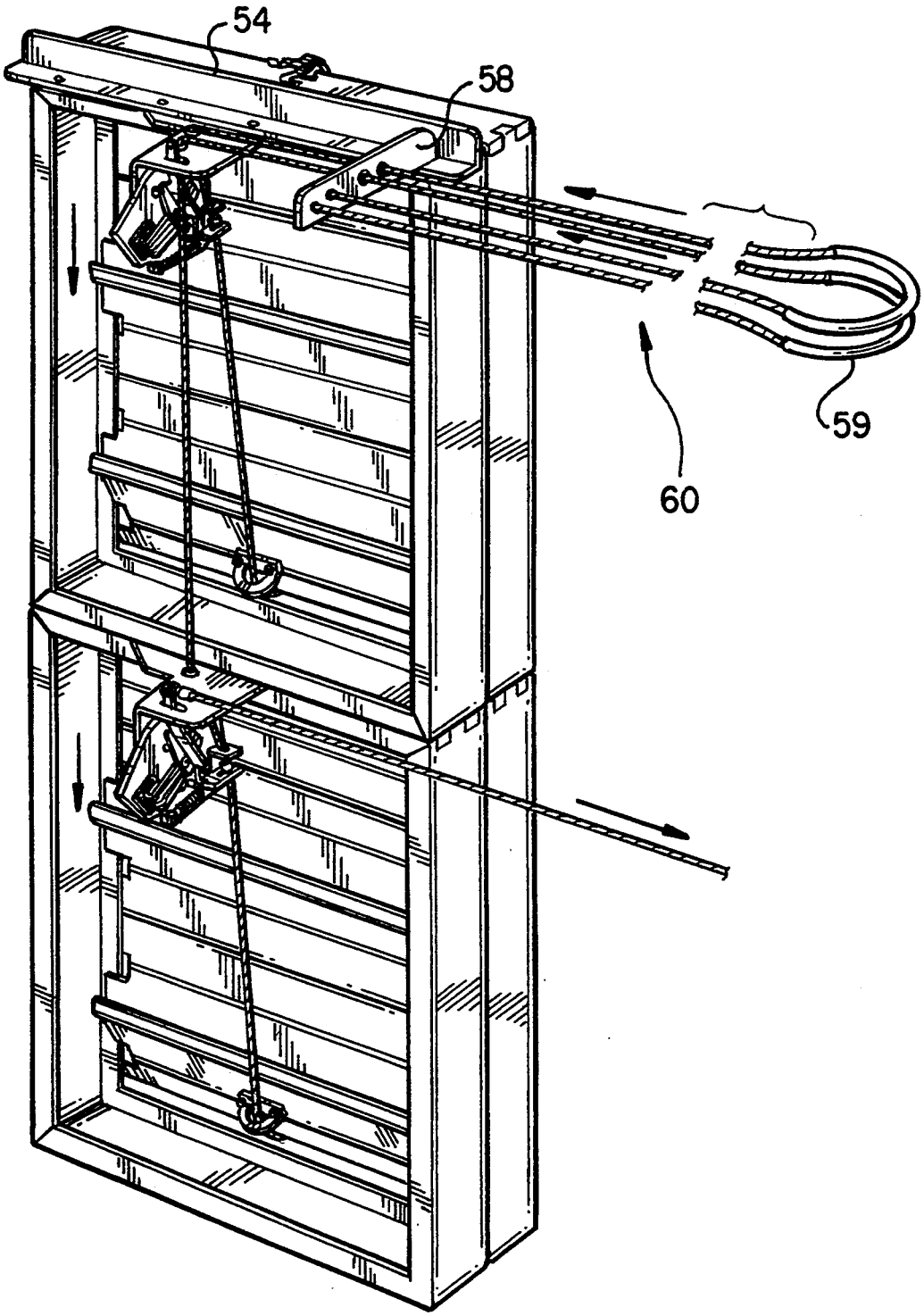
FIG. 8 is a perspective view of another embodiment of the present invention comprising two such devices as shown in the preceding figures.

In the prior art, the damper was mounted in ductwork by means of brackets, such as that shown at 54 in FIG. 8. In most building installations, the ductwork is mounted within the walls and ceilings and is inaccessible in a finished building. Therefore, in order to reset resettable dampers it was necessary to build an access door into the wall or ceiling proximate to the damper so as to gain access to that damper and manipulate the reset controls. As stated above, it is an object of this invention to eliminate the access door. Thus, in accordance with this invention, it is only necessary to run the cables through suitable grommets, such as that shown at 56 in FIG. 3 and holes in guide brackets, such as that shown at 58 in FIG. 8 to whatever remote position in the structure should be desired in the structure. In order to pull the cable so as to fan-fold the blades and raise them to the fully folded position where they can be retained, I have provided a handle such as that shown at 59 in FIG. 8, which is a tubular member through which the cable can pass in sliding engagement. Pulling on the handle will allow the cable to slide through it and be retracted from the damper, thereby engaging the lowermost damper blade and raising the blades in a fan-folded manner as the cable is continually withdrawn. Thus I have provided a cable positioning means designated generally 60 in FIG. 8 engaging the cable to facilitate movement of the cable to retract the blades to a folded position; said cable positioning means being mounted at a location remote from said damper, so that blades can be reset remotely.

To reset the damper, the cable 30 is pulled in a direction opposite the direction shown by the arrow B as shown by the arrow D in FIG. 5, causing the stop means 32 to move from the position shown in full lines in FIG. 5 to the position shown in phantom lines where it engages the bracket 42 and causes the bracket 26 to move about the pivot 36 in the direction shown by the arrow E in FIG. 5. As this movement progresses, the knife-shaped edge 44 of the bracket 26 engages the leading edge of the pin 24 (which is also correspondingly bevelled) and move the pin aside; that is, move the leading edge or free end 20 of the bi-metal portion of the link in the direction of the arrow A in FIG. 6 so that it moves out of the way and allows the bracket 26 to advance until such a point as the pin 24 drops into the slot 28 and once again retains the bracket 26 in a fixed position. The stop means 32 may then drop back slightly with the cable to the position shown in FIGS. 4 and 5, but retain the cable 30 from further release of the fan-folded blades of the curtain until such time as the pivotal bracket 26 is released from engagement with the pin 24.

To further provide for remote actuation as part of the link release means, I have provided a remotely mounted actuating means. I have placed a hole designated generally 46, FIG. 3, in the end of the lever 18 which extends outwardly from the fire damper frame and the mounting bracket 48 which fixes and retains the bi-metal link device to the frame 12 of the damper. This hole is used to attach a release cable 50 shown in FIG. 1. The release cable 50 can be pulled in the direction of the arrow F in FIG. 1 to move the lever 18 and release the mechanism as described above. The lever 18 is rectangular in cross-section and most preferably passes through an elongated slot designated generally 52 in FIGS. 1 and 3 in the mounting bracket 48 which helps to retain the lever 18 so as to allow movement in direction of the arrow A in FIG. 3 even though the cable 50 may not be mounted in such a way as to pull directly on the lever in the direction of the arrow A. In other words, the cable 50 may be mounted in such a way that it would pull at an angle to the direction of travel A, but the portion of the bracket 48 forming the slot 52 would retain the lever 18 so that it would move in the direction of the arrow A and release the link from engagement with the pivotal bracket 26. Any suitable means such as a handle can be applied to the cable 50 to facilitate its being pulled. The cable and the handle attached to it can be mounted at any desirable place in the structure remote from the damper.

From what has been described it will be noted that in operation the device provides a means for remotely actuating a release and re-engagement of the heat-actuated link means for retaining the curtain fire damper. Thus all that is necessary is the provision of a hole or holes at some point in the structure forming the environment surrounding the duct work and damper frame, through which hole or holes the cables 30 and 50 can be fed; thereby eliminating the need for an access door to reach the resettable mechanism.

In FIG. 8 I show a further embodiment of my invention in which a number fire dampers may be controlled by cables extending through more than one bracket and a number of release mechanisms may be actuated by a number of independently controlled cables; all in accordance with my invention.

From what I have described above it is apparent that there is no longer a necessity for providing an access door in order to test and release and reset curtain type fire dampers.

I claim:

1. For use with a curtain-type fire damper, having a plurality of blades movable from a folded, open position to an unfolded, closed position, a cable movable to engage said blades and move them from an unfolded condition to a folded condition or to release said blades from their folded condition so that they can unfold, and a resettable, heat-actuateable link means for retaining the cable and blades in the folded condition and releasing them as aforesaid; a release/reset means, remotely actuateable, comprising:

a) a bracket pivotally mounted in said damper and configured to be engaged with and retained by said link means when the blades are in the folded condition, and released from said engagement so as to be able to pivot in a first direction upon release of said blades as aforesaid;

b) a spring connected to said bracket to urge it to pivot in said first direction;

c) a stop means engaging said cable and positioned to engage said bracket to pivot said bracket in a second direction, opposite to said first direction upon movement of said cable in a third direction, to a position of engagement with said link means as aforesaid; and said stop means further engaging said bracket when said bracket is in the position of retention by said link means, to retain said cable and thereby retain said blades in their folded condition;

d) said bracket being configured and positioned with respect to said stop means to disengage from said stop means when the link means disengages from the bracket to permit it to pivot in said first direction, and thereby release the cable so that the blades can move to the unfolded condition;

e) cable positioning means engaging said cable to facilitate movement of said cable to retract said blades to their folded condition; said cable positioning means being mounted at a location remote from said damper, so that said blades can be reset remotely; and f) link release means juxtaposed to said link means; said link release means having actuating means mounted remotely from said damper, to actuate said link means to cause the release of said blades as aforesaid.

2. The invention of claim 1 wherein said link release means comprises a lever fixedly attached to the link means; said lever extending from said damper and a cable attached to said lever to move said lever and thereby move said link means to release said bracket as aforesaid.

3. The invention of claim 1 or claim 2 wherein the cable extends from said damper to a position remote therefrom and said cable positioning means comprises brackets through which said cable passes.

4. The invention of claims 1 or 2 wherein the cable positioning means comprises a handle mounted in sliding engagement with said cable at a position remote from said damper.

* * * * *